US006149029A

United States Patent [19]

de Meyer et al.

[11] Patent Number: 6,149,029

[45] Date of Patent: Nov. 21, 2000

[54] MEDICINE EJECTING APPARATUS FOR A BLISTER-TYPE MEDICINE STRIP

[75] Inventors: Pieter H. de Meyer, Raamsdonkveer; Rob E. A. Froeling, Oosterhout; Paul J. Seegers, Dongen; René J. van Geer, Rijswijk; Hendrik-Jan Vertegaal, Leiden, all of Netherlands

[73] Assignee: Innocreate N.V., Curacao, Netherlands Antilles

[21] Appl. No.: 09/404,620

[22] Filed: Sep. 23, 1999

Related U.S. Application Data

[63] Continuation of application No. PCT/NL97/00154, Mar. 26, 1997.

[51] Int. Cl.[7] ..... G07F 11/66

[52] U.S. Cl. ..... 221/25; 221/26

[58] Field of Search ..... 221/25, 26, 30, 221/197; 206/528, 531, 532

[56] References Cited

U.S. PATENT DOCUMENTS 4,858,207 8/1989 Buchner .
5,975,347 11/1999 Labelet, Jr. et al. ..... 221/25

FOREIGN PATENT DOCUMENTS 0 315 951 5/1989 European Pat. Off. .
0 547 426 6/1993 European Pat. Off. .
WO 91/11167 8/1991 WIPO .

*Primary Examiner*—Kenneth W. Noland
*Attorney, Agent, or Firm*—Hoffmann & Baron, LLP

[57] ABSTRACT

Medicine ejecting apparatus comprising a chamber (13) between first and second housing parts (11, 12). A carrier (16) having ejection members (51, 52, 53) opposite the second housing part (12) is situated in the chamber (13). Opposite the carrier (16), the second housing part (12) can retain a medicine strip (82) of the type having one or more rows of blisters (83, 84) containing a medicine. Bottoms of the blisters (83, 84) are situated opposite ejection openings (14, 15) of the second housing part (12). The housing parts (11, 12) have toothed tracks (21, 31), and the carrier has hook members (41, 48) interacting with the toothed tracks, which hook members are such that, if the housing parts (11, 12) are moved to and fro, the carrier (16) also moves over a distance of one tooth pitch and thereby presses a medicine out of a following blister (83, 84) through the bottom thereof and through an ejection opening (14, 15). At the end of the toothed tracks (21, 31), the housing parts (11, 12) have recesses (27, 311), and the carrier (16) interacts with spring means (43, 44), which are such that the carrier (16), after a medicine has been pressed out of a final blister (84), is unlocked from the second housing part (12) and can then be slid back free from the toothed tracks (21, 31), together with the second housing part (12). When a strip (82) filled with medicines is placed in position, the carrier (16) can be pushed back into engagement with the toothed tracks (21, 31) by the strip (82).

13 Claims, 4 Drawing Sheets

MEDICINE EJECTING APPARATUS FOR A BLISTER-TYPE MEDICINE STRIP

This application is a continuation of PCT/NL97/00154, filed Mar. 26, 1997.

The invention relates to a medicine ejecting apparatus in accordance with claim 1.

A medicine ejecting apparatus of this kind is known from the American Patent Specification 4,858,207. Opposite each blister of a medicine strip of the type having one or more parallel rows of blisters which contain a medicine, a first housing part of the known apparatus has a push-button, which can be pressed in perpendicular to the strip, counter to the action of a spring, for the purpose of pressing a medicine out of the opposite blister and through an ejection opening of a second housing part. The push-button is substantially cylindrical and projects through an opening of a plate, which is arranged in the first housing part and can be displaced parallel to the strip counter to the action of other spring means. The diameter of the said opening of the displaceable plate is sufficiently large to allow through a projection provided on the side of the cylindrical button. The projection has a run-up surface, the distance of which from the centre line of the cylindrical button decreases in the direction of the ejection opening. When the button is pressed in, the projection strikes against the edge of the opening of the plate, as a result of which the plate moves in order to allow through the projection and to press a medicine out of the associated blister. When the projection has passed right through the opening of the plate, the plate is moved back by the action of the spring means, as a result of which the button remains in the pressed-in position. When another button is subsequently pressed in, the same thing happens to this next button, but the previously pressed-in button is returned to the starting position by the action of its spring. Coupled to the displaceable plate are switching means, which on displacement of the plate are operated so as to supply a control signal to a timer of the apparatus. On receiving the control signal, the timer starts a predetermined time interval. After the end of the time interval, the timer controls alarm means for supplying an alarm message. Irrespective of the time at which a button is pressed in, any alarm message is stopped and the timer is restarted.

Using the known apparatus, it is possible for a plurality of buttons to be pressed in simultaneously, so that a plurality of medicines are pressed out of the medicine strip simultaneously. Insofar as the electronic means are suitable for counting and displaying the number of displacements of the plate, in the event of a plurality of buttons being pressed in simultaneously there is no correct indication of the number of medicines pressed out of the strip, Another drawback of the known apparatus is that the sequence in which the buttons are pressed in may be arbitrary, which, when using strips containing specific medicines, entails an undesirably great risk of erroneously pressing out and taking the medicines. This is a problem if the medicines are, for example, contraceptive pills. In the case of some medicines, for example blood-pressure-regulating medicines, this may even cause a life-threatening situation.

Yet another drawback of the known apparatus is that the apparatus comprises a large number of mechanical components, making the apparatus liable to faults and making it difficult and expensive to manufacture.

The object of the invention is to eliminate the drawbacks of the known apparatus.

This aim is achieved according to the invention by means of the medicine ejecting apparatus as described in claim 1.

During each movement for pressing out a medicine, comprising a movement to and fro of the housing parts with respect to one another, the first and second hook members are alternately in a fixed position and in a free position, respectively, with regard to the first and second toothed tracks, respectively, interacting therewith, of the first and second housing parts, respectively. During each ejection stroke, the ejection member carrier is displaced, in a pressing-out direction, over a distance of only one tooth pitch. As a result, the ejection members can only press one medicine out of one blister of the medicine strip at any one time.

The order in which a medicine is pressed out of the blisters of the strip is fixed, so that mistakes in the order in which the medicines are taken are ruled out.

Apart from optional electrical means, the apparatus comprises only four components, namely two housing parts, a support and a spring. As a result, the apparatus can be produced very simply and inexpensively.

By using electrical means, the apparatus can be made suitable for making the pressing-out of a medicine by means of displacement of the housing parts dependent on certain conditions. If the medicines are contraceptive pills, the electrical means may, for example, be suitable for removing a block, which prevents the displacement of the housing parts, after an interval of 24 hours each time.

Since only one pill can be pressed out at any one time, the number of pills pressed out can be counted reliably. The electrical means may, depending on the number counted, adjust the conditions for removing the block and an alarm message.

Other properties and advantages of the invention will emerge from the following explanation, with reference to the drawings of a preferred embodiment of the medicine ejecting apparatus according to the invention. In the drawings.

In the figures, the various components are provided with reference numerals, the first digit of which refers to the figure in combination with which they were first illustrated. Identical components are provided with identical reference numerals in the various figures.

Figure 1:
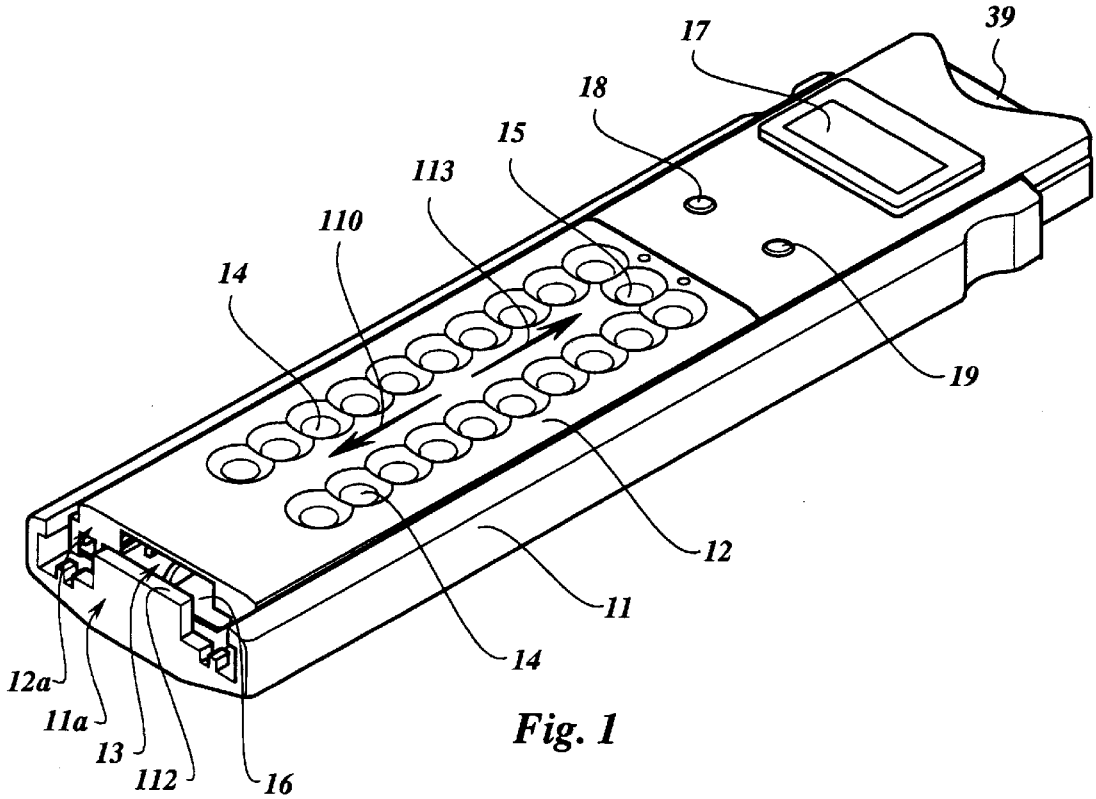
FIG. 1 shows a perspective view of a preferred embodiment of a medicine ejecting apparatus according to the invention, in a not fully closed position.

The preferred embodiment shown in FIG. 1 of the medicine ejecting apparatus according to the invention comprises a housing which comprises a first, or bottom, elongate housing part 11 and a second, or top, elongate housing part 12. The housing parts 11, 12 engage in one another such that they are displaceable with respect to one another in their longitudinal direction. The housing parts 11, 12 delimit a chamber 13, which is suitable for receiving and retaining a blister-type medicine strip, such as the strip 82 shown in FIG. 8. The strip 82 has a number of rows (in FIG. 8 two rows) of blisters 83 made of a relatively rigid, usually transparent material, which blisters are each closed by a bottom layer of relatively weak material, which is suitable for a medicine to be pressed through it, out of the blister. The rows of blisters 83 have first and second ends. The strip 82 shown in FIG. 8 has a further, intermediate blister 84 between the second ends of the rows of blisters 83. The strip 82, shown by way of example, has 21 blisters for 21 medicines, which in this example are in particular contraceptive pills.

The second housing part 12 has two rows of ejection openings 14 and an intermediate ejection opening 15, which in the closed position of the housing are situated opposite the blisters 83 and 84, respectively, of a medicine strip 82 retained in the chamber 13.

A carrier 16, which is displaceable inside the chamber 13 in the longitudinal direction of the housing parts 11, 12, is situated in the chamber.

The medicine ejecting apparatus according to the invention may, as shown, have electronic means, which may comprise a message display screen 17 and keys 18, 19. The electronic means preferably comprise a timing device, as described in another international patent application which was filed today by the applicant.

It should be emphasized that the medicine ejecting apparatus according to the invention can also be used without electronic means of this kind for pressing medicines out of a medicine strip 82, as will become apparent from the explanation below.

It should furthermore be pointed out that the housing parts may also have different forms. For example, one of the housing parts may be L-shaped in longitudinal section, electronic means optionally being arranged in the short limb and it being possible for the other housing part to slide over the long limb on the side of the short limb.

FIG. 1 shows a situation in which the housing is not completely closed. When the housing is completely closed in the direction of the arrow 110, the left-hand sides 11*a*, 12*a*, in FIG. 1, of the housing parts 11, 12 will ultimately coincide.

Figure 2:
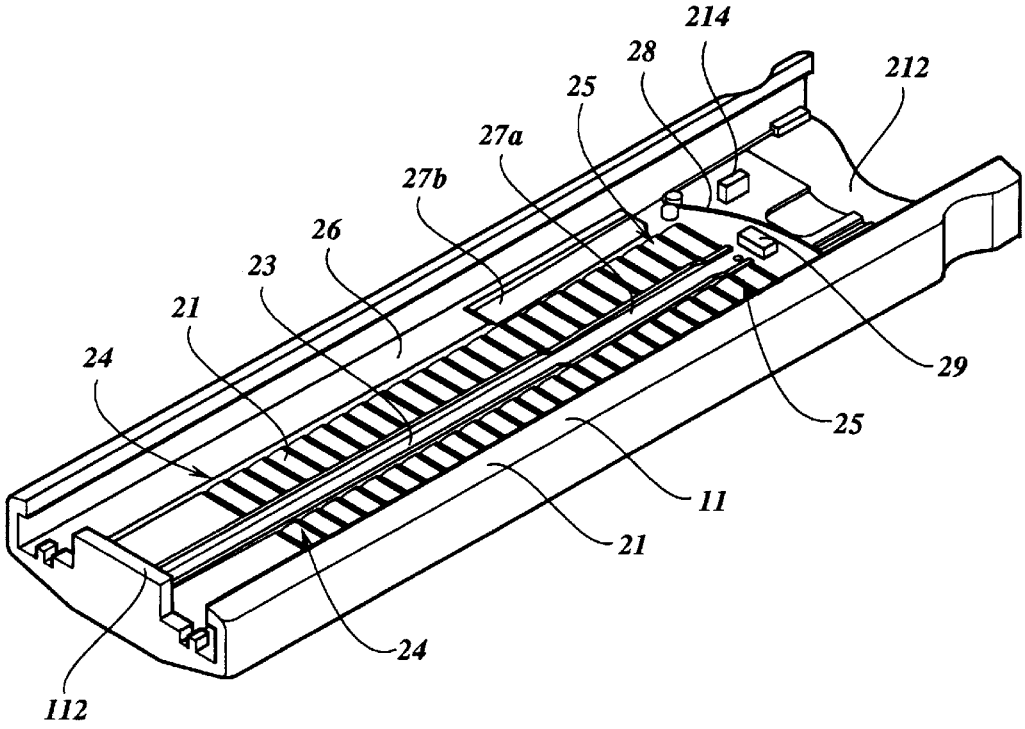
FIG. 2 shows a perspective view of a first housing part of the apparatus of FIG. 1.

As can be seen in FIG. 2, the first housing part 11 has two first toothed tracks 21 on either side of a guide groove 23, which extends in the longitudinal direction of the housing part 11. The toothed tracks 21 have first ends 24 and second ends 25, which are respectively situated further from and closer to the ejection opening 15 of the second housing part 12.

The carrier 16 can be displaced over side base sections 26 next to the toothed tracks and the central guide groove 23. At the second ends 25, the guide groove 23 and the said side sections 26 form a recess 27*a* and 27*b*, respectively, for the carrier, which recesses are jointly referred to below as first recess 27 and are delimited by an inclined run-up surface in the region of the transition to the unrecessed section.

A wire spring 28, which pushes the housing parts 11, 12 towards the closed position of the housing, is arranged in the first housing part.

The first housing part has a stop 29 between the spring 28 and the guide groove 23.

Figure 3:
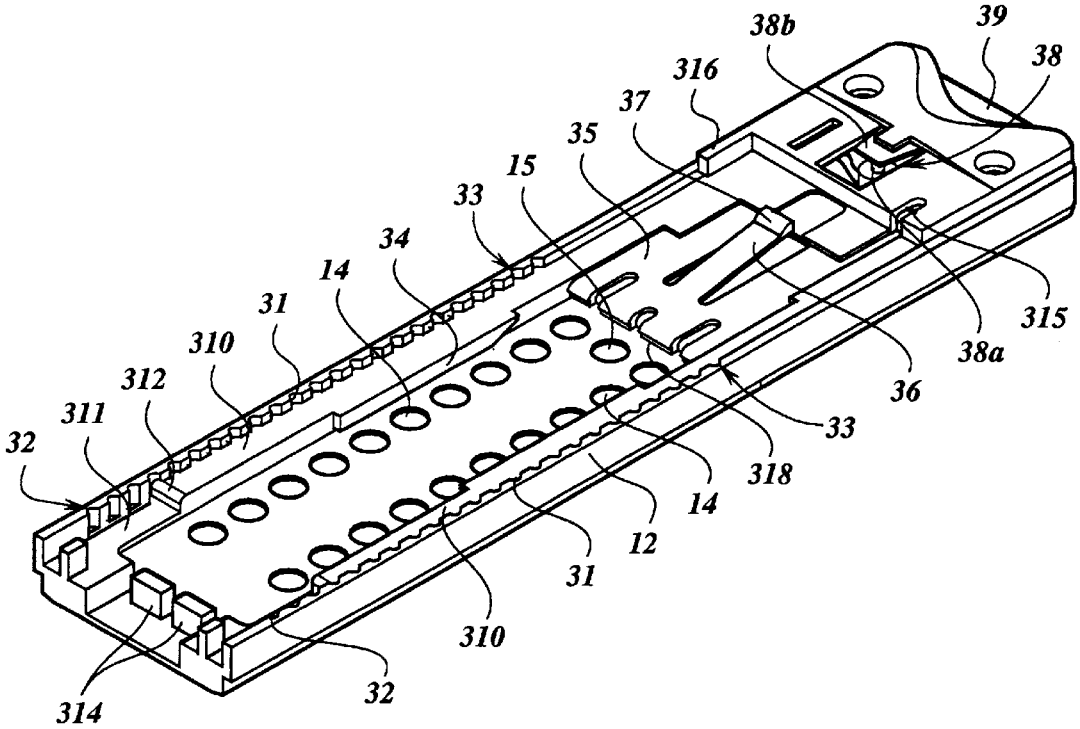
FIG. 3 shows a perspective view of a second housing part of the apparatus of FIG. 1.

As shown in FIG. 3, the second housing part 12 has second toothed tracks 31 on opposite internal side walls in the longitudinal direction of the housing part 12, which second toothed tracks have first ends 32 and second ends 33, of which the second ends 33 are situated closer to the ejection opening 15. A guide rib 34, having rounded ends in the vicinity of the second ends 34 of the second toothed tracks 31, is situated below a section of each second toothed track 31 and at a small distance from the base of the housing part 12. The position of the guide rib 34, and the distance thereof from the base of the second housing part 12, are suitable for sliding a medicine strip 82 under the guide ribs 34 in the manner shown in FIG. 8 in the direction of the arrow 85. When the strip 82 of pills has been put completely in position, one end of the strip 82 is retained in a groove 318 which is situated beneath the end of an end section 35 of the second housing part 12 which delimits the chamber 13 beyond the ejection opening 15.

Centrally and in the longitudinal direction of the second housing part 12, the end section 35 has an elongate resilient tongue 36, which at one end has a projection 37 facing towards the first housing part 11 and having an inclined run-up surface on the hinge side of the tongue. When the housing part 12 is displaced in the direction 113 during a medicine ejection stroke, the projection 37 of the second housing part 12 strikes against the stop 29 of the first housing part 11.

The end section 35 of the second housing part 12 preferably includes the said electrical means 17, 18, 19, as well as an electrically controllable blocking member 38 and a switch key 39. The electrically controllable blocking member 38 serves, in a position in which the housing parts 11, 12 have been slid fully together, to prevent the possibility of the housing part 12 being displaced in the direction 110 during a period within which displacement is not permitted.

The electrically controllable blocking member 38 may be of various forms, for example a permanent magnet bar hich can be moved into an electric coil which is arranged transversely to the sliding direction of the housing parts 11, 12 and whereby one end of the magnet does or does not block a channel for a projection of the first housing part 11. Small metal plates may be arranged opposite the ends of the magnet, in order to retain the magnet against one plate or against the other plate following excitation of the coil in one direction or the other.

Another embodiment of the electrically controllable blocking member 38 is shown in FIG. 3 and comprises a coil with a core 38*a*, the axes of which are perpendicular to the principal planes of the housing parts 11, 12. A flat armature 38*b* is arranged above the core 38*a*, which armature can be hinged about an axis which is perpendicular to the sliding direction and the axis of the core 38*a* and which is situated between the core 38*a* and the key 39.

Opposite the armature 38*b*, the first housing part 11 has a recessed end section or a recess 212. In the closed position of the housing, the armature 38*b* of the blocking member 38 is situated in the recess 212. If the coil receives a suitable electric current from the electrical means, the armature 38*b* is attracted by the core, as a result of which the armature 38*b* moves out of the recess 212, so that the second housing part 12 can be displaced in the direction 110 with respect to the first housing part 11. The coil may, for example, be actuated by a timer after a predetermined time from a starting instant. The switch key 39 can be used to enable the supply of current to the coil only if the key 39 is pressed in at the same time as a displacement of the second housing part 12 with respect to the first housing part 11.

Figure 10:
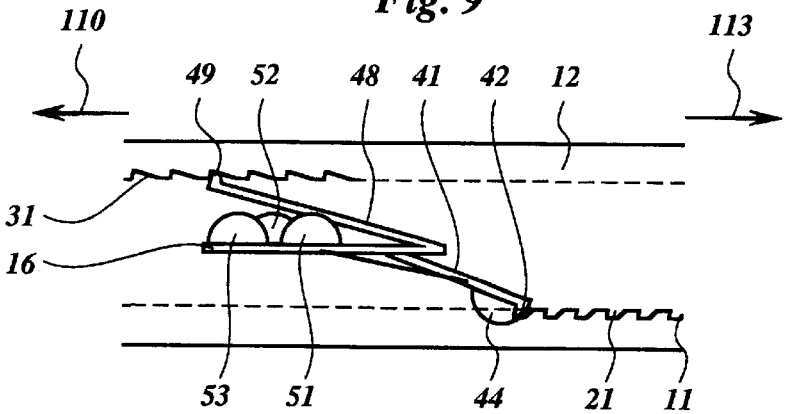
FIG. 10 shows a diagrammatic depiction of a section of the apparatus of FIG. 1 for the purpose of illustrating the operation thereof.

It can be seen in the figures that the teeth of the first toothed tracks 21 and of the second toothed tracks 31 are of a height which increases in the direction 113 (FIGS. 1, 10). The pitch of the teeth is equal to the pitch of the blisters of a row of blisters 83 of a medicine strip 82 divided by the number of rows of the strip 82. Although according to the invention a row may also comprise only one blister, such as the blister 84 of FIG. 8, this is not always necessary, as will become apparent below. As a result, the pitch of the teeth for a strip 82 having an arrangement of rows of blisters as in FIG. 8 may be limited to half instead of a third of the pitch of the blisters 83 of a row comprising a plurality of blisters. As a result, the teeth do not have to be so fine, so that they can be produced more easily and more inexpensively. Furthermore, using the coarser tooth pitch for pressing out the strip 82 shown having the twenty-one blisters 83, 84 means that only twenty-one pressing-out movements are necessary, instead of thirty.

Figure 5:
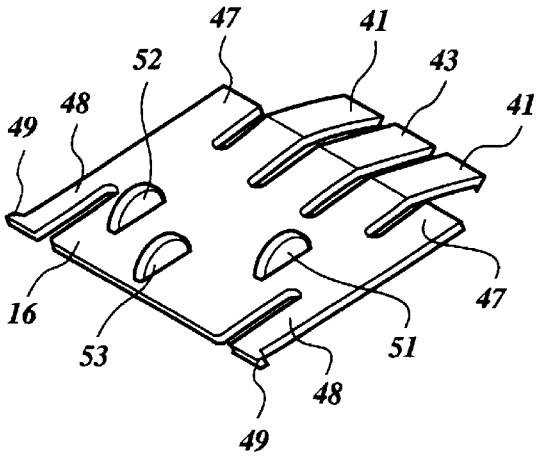
FIG. 5 shows a perspective top view of the carrier of FIG. 4.
Figure 4:
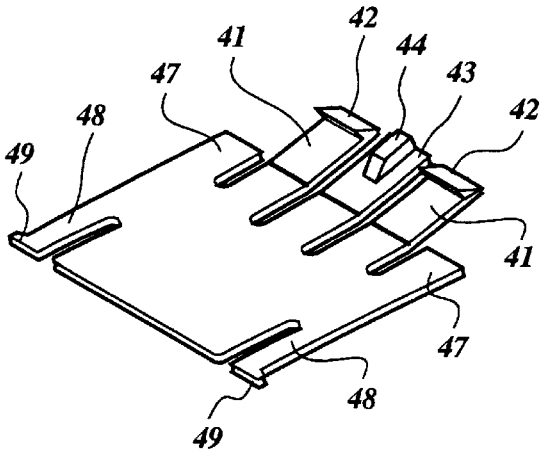
FIG. 4 shows a perspective bottom view of a medicine ejection member carrier inside the apparatus of FIG. 1.

Assuming that the first housing part 11 is a bottom housing part, FIG. 4 shows a bottom view of the carrier 16 and FIG. 5 shows a top view of the carrier 16.

In the longitudinal direction of the housing parts 11, 12, the carrier 16 has extended, elongate, resilient first hook members 41 with hook ends 42. The hook ends 42 are suitable for engaging in the toothed tracks 21 of the first housing part 11.

An elongate, resilient tongue 43 having a guide projection 44, which serves for guidance in the guide groove 23 and opposite the first housing part 11 has an inclined run-up surface, is situated between the hook members 41 for the first toothed tracks 21. The hook members 41 and the central tongue 43 are bent away from a principal plane of the carrier 16 towards the first housing part 11. The length and the shape of the central tongue 43 are such that, following assembly of the housing parts 11, 12, the carrier 16 always tends to press against both housing parts 11, 12 (at changing locations).

Outside the hook members 41, the carrier 16 is bounded by guide pieces 47 which are aligned with the hook members 48.

At the sides, and parallel to the second toothed tracks 31, the carrier 16 has resilient side hook members 48 with hook ends 49. The hook ends 49 are suitable for engaging in the toothed tracks 31 of the second housing part 12.

On the top side, the carrier 16 has two outer ejection members 51, 52 and a central ejection member 53, The ejection members 51, 52, 53 are arranged closer in that order to the projection 29 of the bottom housing part 11.

The ends of the elongate guide sections 310 at the second ends 32 of the toothed tracks 31 of the second housing part 12 have a second recess 311 towards the bottom of the second housing part 12. A run-up surface 312 is situated at the transition from the guide section 310 to the recess 311.

The operation of the medicine ejecting apparatus according to the invention will be explained below.

It should first be noted that FIG. 10 shows the principle of the operation of the apparatus when the carrier 16 is guided between the guide surfaces 26 of the first housing part 11 and the elongate guide sections 310 of the second housing part 12. For the sake of clarity, in FIG. 10 the side hook members 48 with the hook ends 49 are shown facing upwards instead of sideways. It will thus also become clear that other orientations and forms of the toothed tracks 21, 31 and of the hook members 41, 48 are possible within the scope of the invention.

Figure 9:
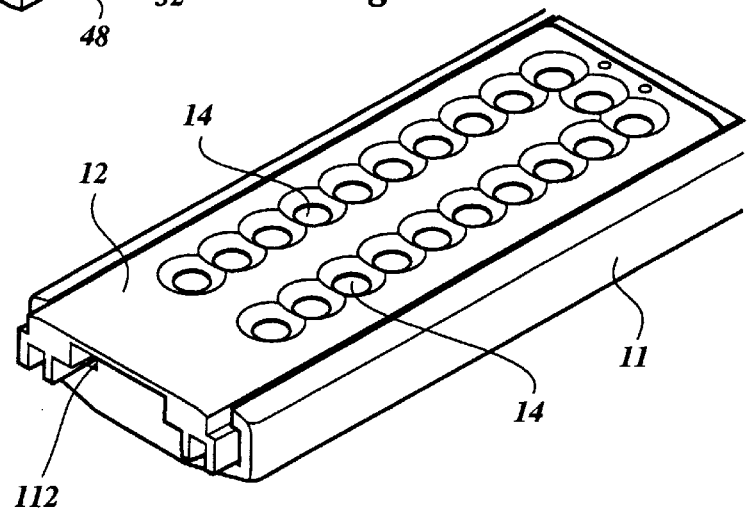
FIG. 9 shows a perspective view of a (left-hand) end section of the apparatus during a movement for pressing out a medicine.

If, in the situation illustrated in FIG. 10, the second housing part 12 is pushed in the direction 110 with respect to the first housing part 11, the hook end 42 of each hook member 41 remains hooked behind a tooth of the toothed track 21, so that the carrier 16 is fixed in position with respect to the first housing part 11. By contrast, the hook end 49 of each side hook member 48 will slide over a tooth of the corresponding second toothed track 31. The movement of the second housing part 12 in the direction 110 is limited by the fact that stop members 314 of the second housing part 12 strike against an end piece 112 of the first housing part 11. The situation shown in FIG. 9 is then reached. If the second housing part 12 is then released, the spring 28 on the side of the recess 212 will press against a raised portion 316 of the second housing part 12 such that the second housing part 12 is slid back in the direction 113. During this displacement, one tooth of each toothed track 31 of the second housing part 12 will strike against the associated hook end 49 of a hook member 48, as a result of which the second housing part 12 will push the carrier 16 onwards in the direction 113, and the hook end 42 of each hook member 41 will slide over a tooth of the first toothed track 21 of the first housing part 11. This displacement of the second housing part 12 is limited due to the fact that the projection 37 of the resilient tongue 36 strikes against the stop 29 of the first housing part 11. During these movements of the second housing part 12 in the direction of the arrows 110 and 113, the distance of movement always lies between one pitch and two pitches of the toothed tracks 21, 31. If a medicine strip 82 is arranged between the second housing part 12 and the carrier 16, during the movement of the second housing part 12 in the direction 110 one of the ejection members 51, 52, 53 will press against a blister 83, 84 and, given a suitable form of the ejection member, will press the medicine out of the blister and through the opposite ejection opening 14, 15. During the movement of the housing part 12 to and fro, a projection 214 of the bottom housing part 11 will actuate a switching means, such as a switch 315, of which only an arm is shown, of the second housing part 12. The signal which is then obtained from the switch 315 can be used by the electrical means in order, for example, to count the number of medicines pressed out and/or to restart a timer.

Figure 6:
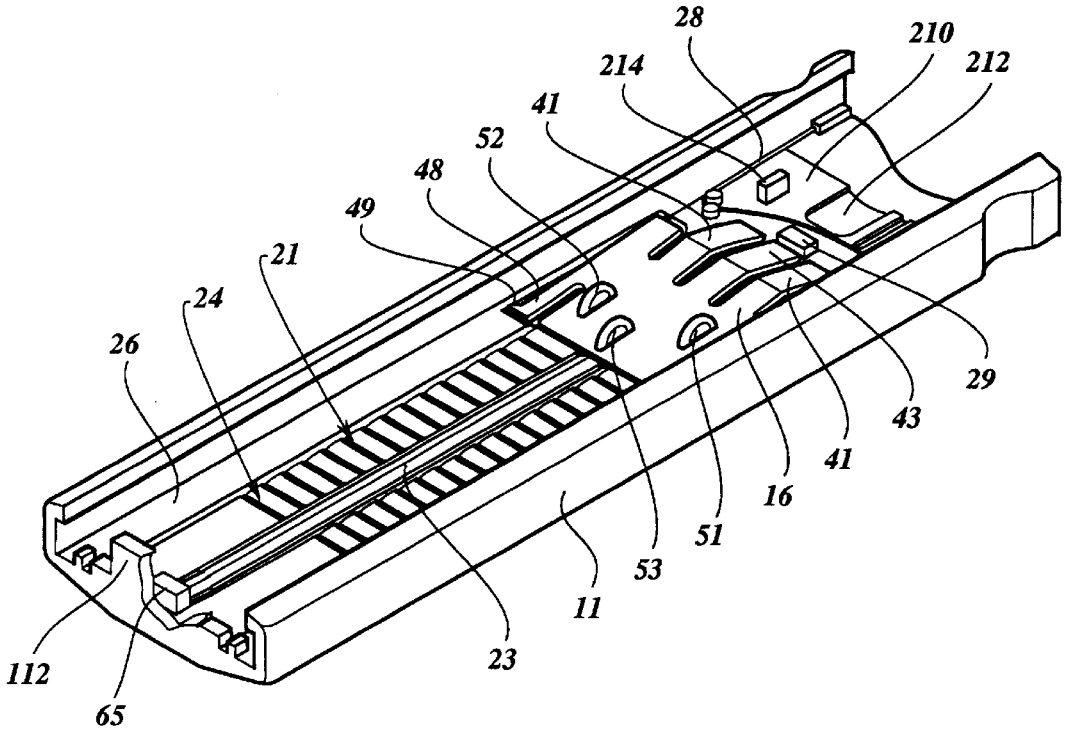
FIG. 6 shows a perspective view of the first housing part with the carrier in a position in which the carrier is unlocked from the second housing part.
Figure 7:
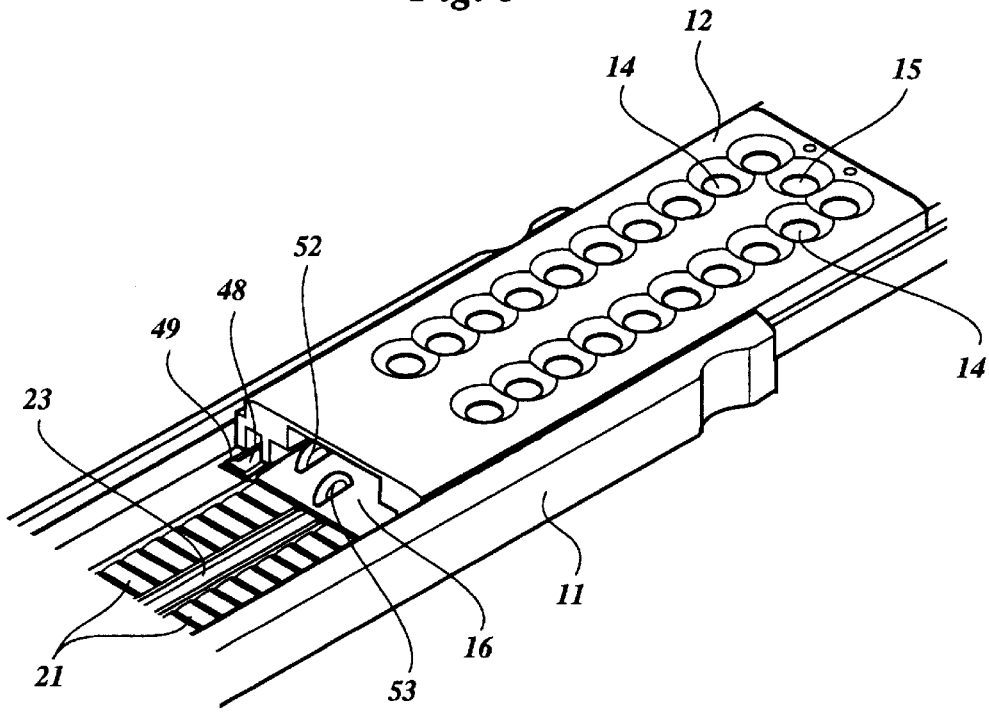
FIG. 7 shows a perspective view of a section of the apparatus of FIG. 1, in a position in which the housing parts are fully extended and the carrier is unlocked from both housing parts.

When the central ejection member 53 has pressed the medicine out of the central blister 84 of the strip 82, the carrier 16 is pressed into the recess 27 by the spring force of the tongue 43, after which the carrier 16 is in the situation shown in FIG. 6. As a result, the hook ends 49 of the side hook members 48 are released from the second toothed tracks 31 of the second housing part 12. As a result, the housing parts 11, 12 can be slid further apart, until the carrier 16 is pressed into the recessed end section 311 of the guide section 310 of the second housing part 12 by the action of the spring tongue 43. As a result, the hook ends 42 of the hook members 41 are also released from the first toothed tracks 21 of the first housing part 11. The situation shown in FIG. 7 is then reached. As a result, the second housing part 12 can then be slid back in the direction 110 in the first housing part 11, bringing with it the carrier 16 in the recess 311, until the carrier 16 strikes against a stop 65 (FIG. 6) at the end piece 112 of the first housing part 11. The situation shown in FIG. 1 is then reached.

Figure 8:
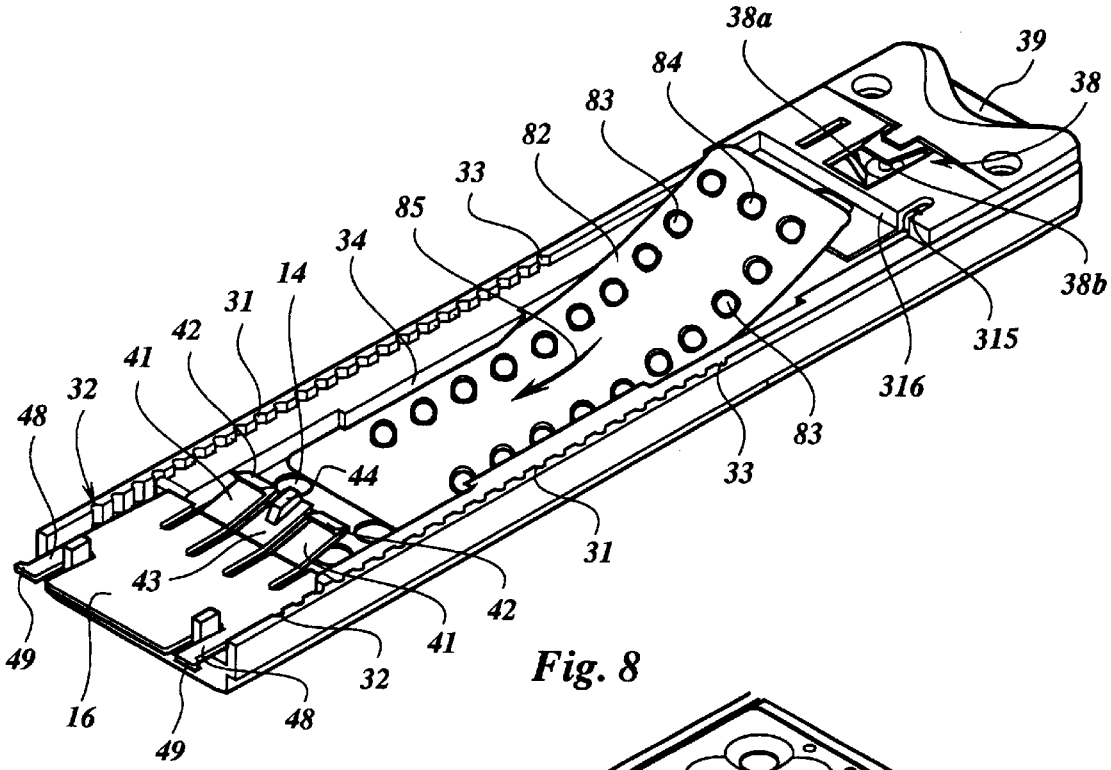
FIG. 8 shows a perspective view of the second housing part, in the position in accordance with FIG. 7, into which a medicine strip is being placed.

To reach the starting situation of the medicine ejecting apparatus with a completely closed housing, it is necessary, when the housing parts 11, 12 have been slid sufficiently far apart (FIG. 7), for a strip 82 filled with medicines to be placed in the second housing part 12, in the manner shown in FIG. 8. The carrier 16 is then lifted slightly out of the recess 311 by the filled strip 82. The height to which it is lifted is determined by tilled blisters and is important for releasing the carrier 16 from the recess 311, as explained below. If the housing parts 11, 12 are then slid together, the carrier 16, as mentioned, strikes against the projection 65 of the first housing part 11. The end of each guide piece 47 of the carrier 16 is then pushed against the inclined run-up surface 312 of the second recess 311, so that the carrier 16 is pushed out of the recess 311. AS a result, the hook ends of the hook members 41 will re-engage with the first toothed tracks 21 of the first housing part 11 and the second housing part 12 can be slid further over the carrier 16 and the first housing part 11 until the armature 38*b* of the electrically controllable stop member 38 falls into the recess 212 and blocks further sliding. From this situation, the medicines can be successively pressed out of the strip 82, in the manner explained earlier, reaching the situation shown in FIG. 9.

An important feature of the medicine ejecting apparatus according to the invention is that only one medicine is pressed out with each pressing-in stroke of the housing parts 11, 12 Another important feature is that after the last medicine has been pressed out of a strip 82, the apparatus unlocks automatically, as a result of which the housing parts 11, 12 can then be displaced freely with respect to one another. Another important feature is that the carrier 16 can easily be slid back into the initial position, without the need for specific actions, after the housing parts 11, 12 have reached the fully extended situation. A further important feature is that the housing cannot be closed when an empty strip is in position. In order to reinforce this feature, moreover, the ejection opening 15 of the second housing part 12 for a single blister 84 could be located towards the region of the first ends 32. The central ejection member 53 should then be arranged in front of the ejection members 51, 52, instead of behind them, viewed in the pressing-out direction 113 of the carrier 16. As a result, the single blister 84 containing a medicine can only serve to counteract incorrect positioning of the strip 82 in the chamber 13.

It will be clear from the above to those skilled in the art that other embodiments of the medicine ejecting apparatus can be realized. For example, the hook members 41, 48 may have different orientations in the longitudinal direction of the toothed tracks 21, 31. If the hook ends 42, 49 have sufficiently inclined run-up surfaces, the teeth of the toothed tracks could even have a rectangular shape. Furthermore, as mentioned, the apparatus may optionally have electrical means which prevent the displacement of the housing parts 11, 12 with respect to one another, optionally for predetermined intervals.

Within the scope of the invention, it is also possible to replace the ejection openings 14 and 15 with one or more larger ejection openings opposite the bottoms of a plurality of blisters 83, 84 of the medicine strip 82. The ejection openings 14, 15 or the larger ejection openings may moreover open into a receiving chamber with a single removal opening, which is arranged, for example, in the vicinity of the ends 32 or 33 of the second toothed tracks 31.

What is claimed is:

1. Medicine ejecting apparatus, comprising a housing having a chamber (13), which is delimited by a first housing part (11) and a second housing part (12), and means for ejecting a medicine and operable inside the chamber, the housing parts (11, 12) being suitable for receiving and retaining in the chamber a medicine strip (82) of the type having one or more parallel rows of blisters (83, 84) containing a medicine and having a constant, equal pitch, the second housing part (12) having at least one medicine ejection opening (14, 15) opposite bottoms of the blisters (83, 84) of a retained strip (82), the ejecting means comprising an ejection member (51, 52, 53) which is suitable for being pressed against a blister (83, 84) to thereby press a medicine out of the blister (83, 84) towards the associated ejection opening (14, 15) through the bottom of the blister (83, 84), characterized in that the second housing part (12) is suitable for retaining the medicine strip (82), the housing parts (11, 12) can be displaced with respect to one another parallel to the rows of blisters (83, 84), the first housing part (11) has at least one first toothed track (21), the second housing part (12) has at least one second toothed track (31), a carrier (16) is arranged in the chamber (13), which carrier can be moved parallel to the toothed tracks (21, 31) between a first position at first ends of the toothed tracks (21, 31) and a second position at second ends of the toothed tracks (21, 31), the carrier (16) has an ejection member (51, 52, 53) opposite each row of blisters (83, 84), which member is suitable for pressing medicines out of successive blisters (83, 84) of the row when the carrier is moved from the first position to the second position in a pressing-out direction, the carrier (16) has a first resilient hook member (41) and a second resilient hook member (48) which are suitable for engaging on the first and second toothed tracks (21, 31), respectively, teeth of the first and second toothed tracks (21, 31) and/or the ends (42, 49) of the hook members (41, 48) are of a height which increases gradually in the pressing-out direction (113), the pitch of the toothed tracks (21, 31) is equal to the pitch of the rows of blisters (83) divided by the number of rows, and the ejection members (51, 52) are arranged on the carrier (16) staggered by a distance of the tooth pitch, viewed in the pressing-out direction (113).

2. Apparatus according to claim 1, characterized in that the carrier (16) has a further ejection member (53) for a single further blister (84) at the ends of the two rows of blisters (83), and the further ejection member (53) is arranged staggered with respect to the other ejection members (51, 52) by a distance of a whole tooth pitch and half a tooth pitch, respectively, specifically, viewed in the pressing-out direction (113) of the carrier (16), in front or after the other ejection members (51, 52) when the further blister (84) is situated in the first position or second position, respectively, of the carrier (16).

3. Apparatus according to claim 1, characterized in that one of the housing parts (11) is suitable for holding in the palm of a hand, while the other housing part (12), at one end thereof, can be pressed in oppositely to the pressing-out direction of the carrier (16), counter to the action of the spring means (28), over a distance of between one and two tooth pitches.

4. Apparatus according to claim 1, characterized in that spring means (43, 44) push the carrier (16) against the housing parts (11, 12), and one of the housing parts (11), at the second end of its toothed track (21), has a first recess (27) which is such that the spring means (43), in the region of the second position of the carrier (16), push the hook member (48), which interacts with the toothed track (31) of the other housing part (12), out of engagement with the toothed track (31) of the other housing part (12).

5. Apparatus according to claim 4, characterized in that the other housing part (12), at the first end of its toothed track (31), has a second recess (311) which is such that the spring means (43, 44), in the region of the second position of the carrier (16), push the hook member (41), which interacts with the toothed track (21) of one housing part (11), out of engagement with the toothed track (21) of one housing part (11).

6. Apparatus according to claim 5, characterized in that the carrier (16) and the spring means (43, 44) are such that, when a strip (82) is placed in the chamber (13), the strip (82) pushes the carrier (16) a limited distance out of the second recess (311), and a transition (312) from the second recess (311) is suitable for pushing the carrier (16) out of the second recess (311) when the carrier (16) subsequently strikes against a stop (65) of one housing part (11).

7. Apparatus according to claim 4, characterized in that the spring means comprise a resilient tongue (43) of the carrier (16).

8. Apparatus according to claim 1, characterized in that the housing parts (11, 12) have stop means (112, 314; 36, 37, 29) which limit the extent to which the housing parts (11, 12) move apart.

9. Apparatus according to claim 1, characterized in that the first housing part (11) has two parallel first toothed tracks (21) opposite a principal plane of the second housing part (12) having the ejection openings (14, 15), the carrier (16) has two first hook members (41) interacting with the first toothed tracks (21), the second housing part (12) has second toothed tracks (31) on two mutually opposite side faces, and the carrier (16) has two hook members (48) interacting with the second toothed tracks (31).

10. Apparatus according to claim 1, characterized in that one of the housing parts (12) has an electrically controllable blocking member (38) and electrical control means connected thereto and the other housing part (11) has a stop (212), such that, in a first position of the blocking member (38), the housing parts (11, 12), when slid into one another, cannot be displaced, and, in a second position of the blocking member (38), the housing parts (11, 12) can be displaced with respect to one another over a pressing-out distance of between one and two tooth pitches.

11. Apparatus according to claim 10, characterized in that one of the housing parts (12) has a switch with an operating key (39), the key (39) can be pressed in counter to the pressing-out direction (113) of the carrier (16), the switch supplies an enable signal, when the key (39) is pressed in, to the electrical control means for enabling the driving of the electrically controllable blocking member (38) to the second position, and when the blocking member (38) is in the second position and the key (39) continues to be pressed in, the housing parts (11, 12) are displaced with respect to one another.

12. Apparatus according to claim 10, characterized in that the housing parts (11, 12) are coupled to a switching means (315), which during or after a medicine ejection stroke supplies an ejection stroke detection signal to the electrical control means, and the electrical control means, beginning at a starting instant determined by the receipt of the ejection stroke detection signal, block the supply of a control signal for driving the electrically controllable blocking member (38) to the second position for a predetermined time interval.

13. Apparatus according to claim 10, characterized in that the electrical control means comprise a timer and alarm means connected thereto, and after a predetermined time interval from the starting instant until a following starting instant, the timer controls the alarm means so as to enable the supply of an alarm message.

* * * * *